United States Patent [19]

Gentry

[11] Patent Number: 4,575,044

[45] Date of Patent: Mar. 11, 1986

[54] LUBRICATOR SECTION

[75] Inventor: Ernest B. Gentry, Dallas, Tex.

[73] Assignee: Otis Engineering Corporation, Dallas, Tex.

[21] Appl. No.: 684,386

[22] Filed: Dec. 20, 1984

[51] Int. Cl.[4] ..... F16K 51/00

[52] U.S. Cl. ..... 251/145; 285/354; 285/388; 166/70; 137/798

[58] Field of Search ..... 285/387, 388, 354, 332; 166/70, 88; 251/145; 137/798

[56] References Cited

U.S. PATENT DOCUMENTS

| | | | |
|---|---|---|---|
| 769,896 | 9/1904 | Gapp | 285/388 |
| 1,016,620 | 2/1912 | Gapp | 285/388 |
| 2,148,746 | 2/1939 | Hompe et al. | 285/354 |
| 2,624,362 | 1/1953 | Church | 251/145 |
| 2,845,940 | 8/1958 | Garrett et al. | 251/145 |
| 3,500,907 | 3/1970 | Gentry | 166/70 |

*Primary Examiner*—A. Michael Chambers
*Attorney, Agent, or Firm*—Roland O. Cox

[57] ABSTRACT

A lubricator section, useful for servicing wells, requiring no welds or threads to connect the box and pin union portions to the tubular body. The box and pin union portions are formed on the tubular body ends. A shoulder, retaining the connecting collar on the pin end, is provided by circular segments lockable between the collar and tubular body. A valve may be connected to the body to permanently lock the segments between the collar and body.

8 Claims, 4 Drawing Figures

LUBRICATOR SECTION

FIELD OF THE INVENTION

This invention relates to lubricator equipment mounted on wellheads for use during well servicing operations, and particularly relates to lubricator sections.

DESCRIPTION OF THE PRIOR ART

Typical lubricator equipment assembled on a wellhead to allow a well to be serviced using wireline techniques include: a well head connector, a wireline valve, one to three lubricator sections, and a stuffing box with or without a sheave. This equipment is usually connected together with union couplings of the type using a threaded connecting collar, which may be quickly connected and disconnected by hand. Examples of some couplings are shown by U.S. Pat. Nos. 1,186,325, 1,244,100, 2,148,746 and 3,930,377.

The lubricator sections, which are required in various lengths, between four and twenty feet, each include a male or pin union portion with a collar connected to one end of an elongate body tube and a female or box union portion connected to the other end of the tube. The box and pin union portions have long been formed on separate pieces and connected to lubricator body tubes by welding or using threaded connections. As each of the lubricator sections may be subjected to extremely high internal pressures of up to 20,000 psi while in use, threaded connections, utilizing both metal to metal and resilient seals, between the pin portion and tube and between the box portion and tube, were found to not be readily capable of containing such pressures. Threaded connections were also found to loosen and leak after repeated use. Lubricator sections using tapered thread connections did not have continuous inside diameters as there were internal gaps in each connection. Well service tools were often inadvertantly activated by connection gaps in these lubricator sections. Examples of lubricator sections with threads connecting the box and pin union portions to the body tube are shown on page 71 of the "Otis Wireline Subsurface Flow Controls and Related Service Equipment" catalog OEC 5121C, a publication of Otis Engineering Corporation, P.0. Box 819052, Dallas, Tex. as 75381-9052.

When the box and pin union portions are connected to the body tube by welding, expensive radiographic weld inspection and manufacturing techniques are required to assure the welds are not porous and have been stress relieved by heat treat. As the weld stress relieving process tempers or softens the metals used for pin, box and tube portions, the whole lubricator section must be reheat treated to bring all metals back up to a strength which will resist the high internal pressures which may be applied during use. Because of the foregoing rigid manufacturing and inspection requirements, scrap and rework rates for welded lubricator sections have been high with resulting increased manufacturing costs.

SUMMARY OF THE INVENTION

The lubricator section of the present invention utilizes a tubular body piece, with a pin union portion (including an external shoulder) formed on one end and a complete box union portion formed on the other end, not requiring welding or threading and metal or resilient seals for connection of separate pin and box union portions to the tubular body. A larger outside diameter is provided on the tubular portion adjoining the pin union portion. A shoulder for retaining the connecting collar on the pin union portion is formed by sliding the collar over the pin portion and larger outside diameter tube to a reduced outside tube diameter and inserting lugged circular segments between the collar and tube and positioning each segment lug in an internal collar groove. Moving the collar back over the larger tube diameter, cams the segment lugs out into the collar groove, locking them in the collar and as the internal segment diameter is limited by the collar groove and now is smaller than the pin portion external shoulder diameter, the collar will not slide back over and off the pin portion and can now be manually screwed onto threads on a mating box union portion until the internal shoulder formed by the segments engages the pin external shoulder and retains mating pin and box union portions connected. A valve may be connected over a port through the larger outside diameter tubular portion wall, preventing the collar from sliding back over the reduced diameter tubular portion, permanently locking the segments in the collar.

An object of this invention is to provide a lubricator section not requiring welds or threads to connect the box and pin union portions to the section tubular body.

Another object of this invention is to provide a lubricator section having box and pin union portions formed on the ends of the section tubular body.

Another object of this invention is to provide a lubricator section wherein the connecting collar is retained on the pin end by circular segments lockable between the collar and tubular body.

Another object of the invention is to provide a lubricator section with a continuous inside diameter not interrupted by connection gaps.

Also an object of this invention is to provide a lubricator section wherein a bleed valve may be connected to the section body to prevent the circular segments from being unlocked for removal from between the collar and tubular body.

BRIEF DESCRIPTION OF THE DRAWING

FIG. 1 shows lubricator equipment, connected to a well head for servicing the well using wireline techniques. A wireline valve 10 is connected to the top of a wellhead connector 11 with a threaded collar type union 12. Connected to the top of the wireline valve with another union 12 is a lower lubricator section 13 of this invention, with a connected bleed valve 14. This valve when open communicates the inside of the section body with regions exterior of the body. Connected to the top of the lower lubricator section is an upper lubricator section of this invention 15, without a bleed valve. Connected to the top of the upper section with another union 12 is a stuffing box with sheave 16.

When servicing a well by wireline, the service tool string is lowered into the well on wireline, which passes through the stuffing box, lubricator sections and open wireline valve and into well tubing. The stuffing box seals around the wireline as it is lowered into or pulled out of the well to retrieve the tool string. The wireline valve is closed, when the tool string is in the lubricator sections, to retain pressure control of the well therebelow and permit pressure trapped in the lubricator sections to be bled-off through the lower section bleed valve. The lubricator sections can then be disconnected from the wireline valve, providing access to the tool string therein.

Figure 2:
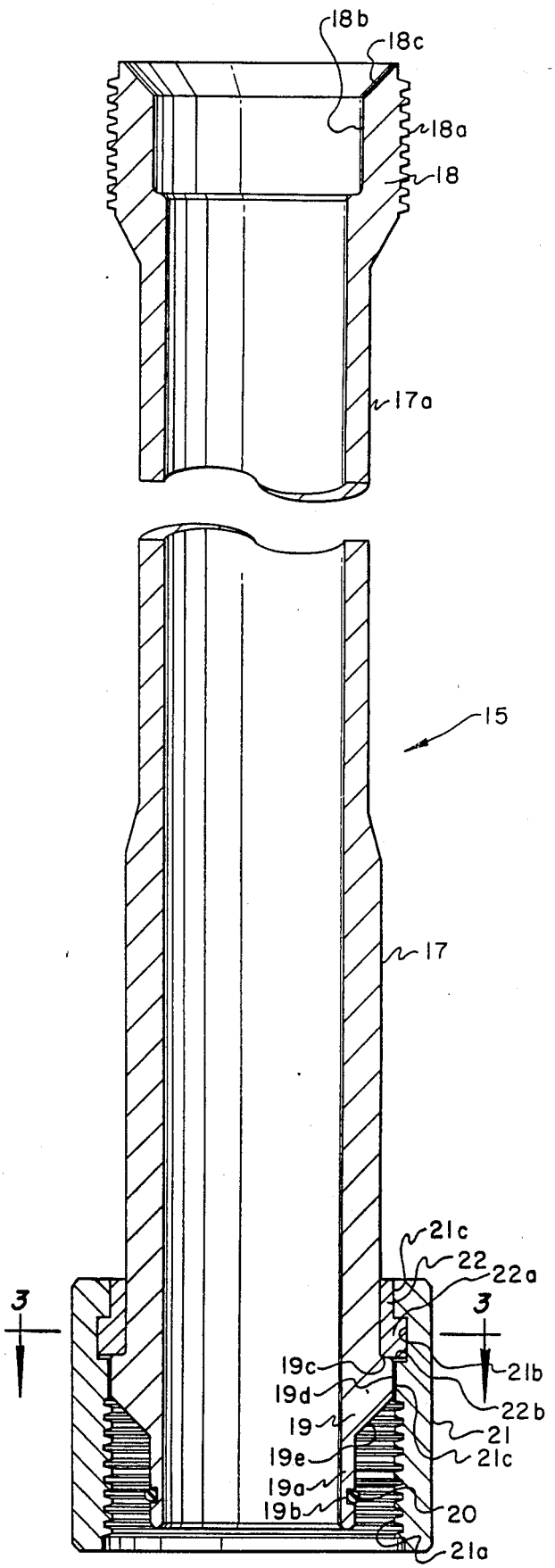
FIG. 2 is a sectioned drawing of a lubricator section of this invention, without a bleed valve.

Referring to FIG. 2, which shows the preferred embodiment of the lubricator section 15 of this invention without a bleed valve, having a tubular body portion 17 with a reduced outside diameter section 17*a*. The box portion of a union 18 has been formed on one end of the body and includes threads 18*a*, seal bore 18*b* and a seal surface 18*c*. The pin portion of a union 19 has been formed on the other end of the body and includes a body extension 19*a* having a groove 19*b* in which is housed a resilient seal 20. Also formed on the pin portion is a shoulder surface 19*c*, a shoulder diameter 19*d* and a sealing surface 19*e*. A connecting collar 21 is prevented from sliding off over shoulder diameter 19*d* by three circular segments 22. Each segment has a shoulder or lug 22*a*, projecting into collar groove 21*b*, and an end surface 22*b* contacting shoulder surface 19*c*. The segment lugs are locked in the collar groove by the larger outside diameter of body 17.

Figure 1:
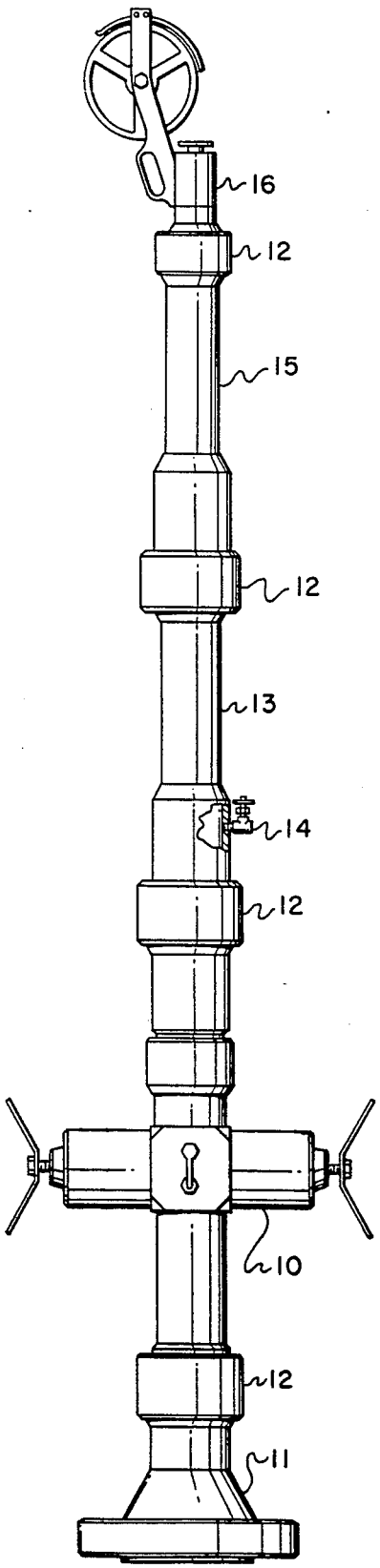
FIG. 1 is a schematic drawing showing lubricator equipment, with lower and upper sections of this invention, which is connected to a wellhead fo servicing the well with wireline.
Figure 4:
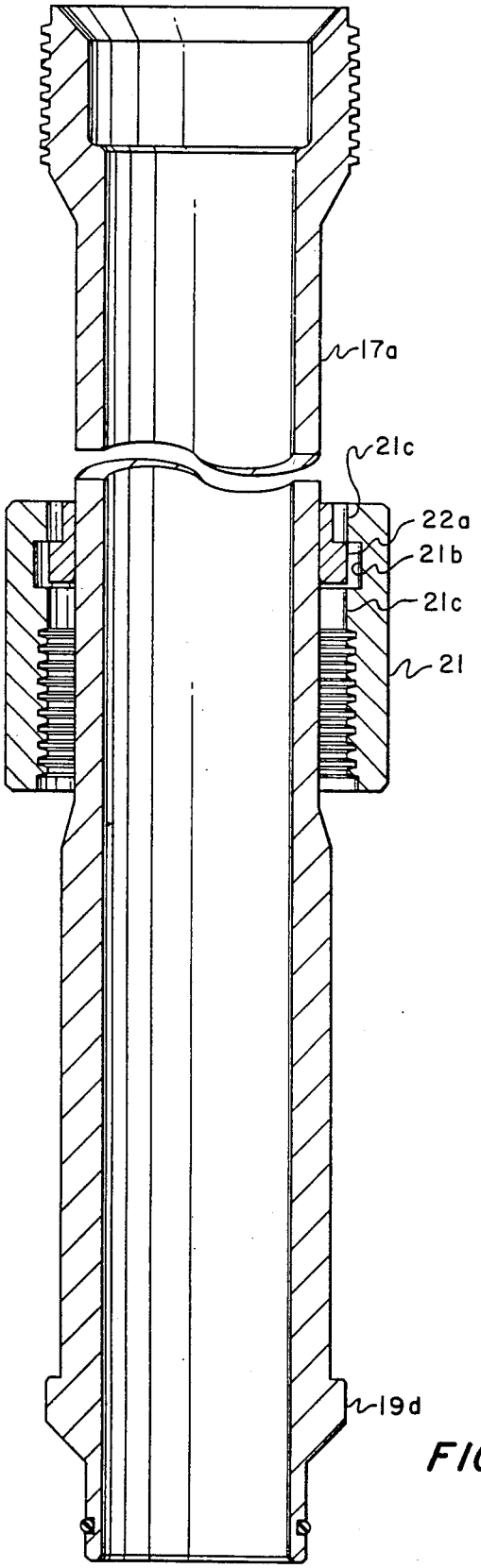
FIG. 4 is a sectioned drawing of a lubricator section of this invention showing the circular segments positioned between the collar and reduced body diameter.
Figure 3:
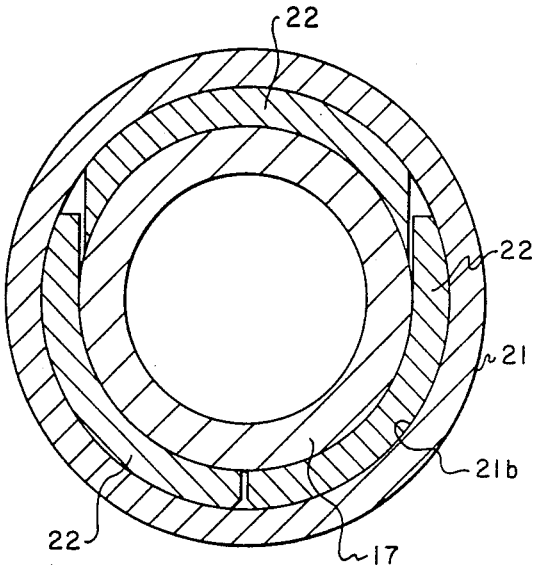
FIG. 3 is a sectional view along line 3—3 of FIG. 2.

FIG. 4 shows the lubricator section 15 wherein collar 21 has been moved over pin shoulder diameter 19*d* to a position around reduced body diameter 17*a*, which provides sufficient clearance between collar diameter 21*c* and body diameter 17*a* for inserting and positioning segment lugs 22*a* in alignment with collar groove 21*b*. The collar is moved eccentric to body diameter 17*a* and a wide segment positioned first, followed by the other wide segment, which is positioned across from the first segment. The wide segments are then moved together as shown in FIG. 3 and the narrow segment is positioned between. Now, moving the collar and aligned segments over the larger outside diameter of the body moves the segment lugs out into the collar groove. The segments are then locked in the groove when on the larger body diameter and the segment inside diameter is less than outside pin diameter 19*d*. The movement of the collar over pin shoulder diameter 19*d* and off the body is prevented as segment end surfaces 22*b* will now contact shoulder surface 19*c*, as shown in FIG. 2. Of course the segments will unlock and may be removed from between the body and collar groove when the collar is moved back over body diameter 17*a*. Movement of the collar off the larger diameter body portion may be prevented by connecting a valve 14 to the lubricator section as shown in FIG. 1.

The section of FIG. 3 also shows how a shouldered ring is cut to form the circular segments 22 and how each segment may be trimmed to require minimum clearance between the body diameter 17*a* and collar diameter 21*c* for positioning in the collar and not require a great increase in collar diameter to maintain collar strength.

To connect a lower lubricator section of this invention (with bleed valve) to other wellhead equipment, the pin end extension 19*a* is inserted into bore 18*b* in a mating box union on the end of the equipment to be connected to. Resilient seal 20 sealingly engages bore 18*b* and insertion may continue until pin seal surface 19*e* contacts box seal surface 18*c*. The collar 21 is then screwed onto mating box threads 18*a* holding segment end surfaces 22*b* against pin shoulder surface 19*c* and the box and pin union portions connected. Further tightening of the collar sealingly engages surfaces 19*e* and 18*c* forming another seal between pin and box union portions in addition to seal 20.

Additional upper lubricator sections or a stuffing box may be connected to the invention section box union portion on the other end of the body. The lower section bleed valve may now be closed, wireline valve opened introducing well pressure into the lubricator equipment and the wireline tool string lowered from the lubricator sections into the well tubing to service the well. On retrieval of the tool string up into the lubricator sections, the wireline valve is closed and the bleed valve is opened to bleed pressure from the lubricator sections.

What is claimed is:

1. A lubricator section comprising:

a. a tubular body having a reduced outside diameter portion, a union box portion formed on the end of said reduced diameter portion, and a union pin portion formed on the other end of said tubular body, said pin portion including an external shoulder, a grooved body extension and a resilient seal housed in said groove;

b. a connecting collar having threads and a groove therein and an inside diameter slightly larger than said pin portion shoulder diameter; and c. circular segments, each having a lug, each said lug positioned in said collar groove when said collar is around said body reduced outside diameter portion, said segment lugs being retained in said groove by said larger tubular body outside diameter when said collar is around said larger diameter where said segments form an inside diameter less than said pin portion shoulder diameter.

2. The lubricator section of claim 1 further including a bleed valve connected over a port through the tubular body wall in the larger outside diameter portion.

3. The lubricator section of claim 1 wherein the union box portion includes a seal bore with surrounding external threads.

4. The lubricator section of claim 3 wherein the union box portion further includes an end frusto-conical sealing surface.

5. The lubricator of claim 4 wherein the union pin portion further includes an external frusto-conical seal surface between the extension and external shoulder.

6. The lubricator section of claim 1 wherein the circular segments are substantially one-third of a ring, said ring cut along a diameter and cut twice parallel to a diameter.

7. A lubricator section comprising:

a tubular body having, a reduced outside diameter portion, a union box portion formed on the end of said reduced diameter portion, said box portion including an internal seal bore surrounded by threads and an end frusto-conical seal surface;

union pin means on the other end of said body including, a pin portion formed on the body including, a grooved body extension, an external shoulder and a frusto-conical seal surface between said shoulder and seal surface;

a resilient seal housed in said body extension groove;

connecting collar, having threads and a groove therein and an inside diameter slightly larger than said pin portion shoulder diameter; and at least three circular segments, each having a lug, each said lug positioned in said collar groove when the collar is around said body reduced diameter portion, said segment lugs being retained in said groove by the larger tubular body outside diameter when said collar is around said larger diameter where said segments form an inside diameter less than said pin portion shoulder diameter.

8. The lubricator section of claim 7 further including a bleed valve connected over a port through the tubular body wall in the larger outside diameter portion.

* * * * *